US005297400A

United States Patent [19]

Benton et al.

[11] Patent Number: 5,297,400

[45] Date of Patent: Mar. 29, 1994

[54] LIQUID DISPENSING ASSEMBLY FOR A REFRIGERATOR

[75] Inventors: Ronald E. Benton; Kurt C. Senner, both of Galesburg, Ill.

[73] Assignee: Maytag Corporation, Newton, Iowa

[21] Appl. No.: 18,704

[22] Filed: Feb. 17, 1993

[51] Int. Cl.[5] ..... F25C 5/18

[52] U.S. Cl. ..... 62/389; 222/146.6

[58] Field of Search ..... 62/389, 98, 396; 222/108, 146.6

[56] References Cited

U.S. PATENT DOCUMENTS

| | | | |
|---|---|---|---|
| 2,775,374 | 12/1956 | Tamuringa | 222/108 |
| 3,429,140 | 2/1969 | White | 62/389 |
| 4,276,750 | 7/1981 | Kawasumi | 62/137 |
| 4,610,375 | 9/1986 | Germi et al. | 222/131 |
| 4,830,223 | 5/1989 | Priest | 222/146.6 |
| 5,033,273 | 7/1991 | Buchser et al. | 62/344 |

*Primary Examiner*—Henry A. Bennet
*Assistant Examiner*—William C. Doerrler
*Attorney, Agent, or Firm*—Bacon & Thomas

[57] ABSTRACT

A liquid dispensing assembly for a refrigerator includes a liquid supply line that extends into an ejection spout located above a fill chamber, closely adjacent the inner surface of a refrigerator door. The ejection spout defines a nozzle that is angled downwardly and rearwardly to direct the discharge path of the spout into a container placed in the fill chamber.

13 Claims, 3 Drawing Sheets

FIG. 1
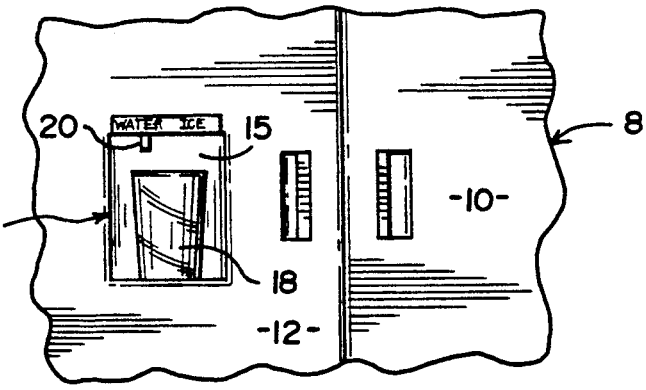
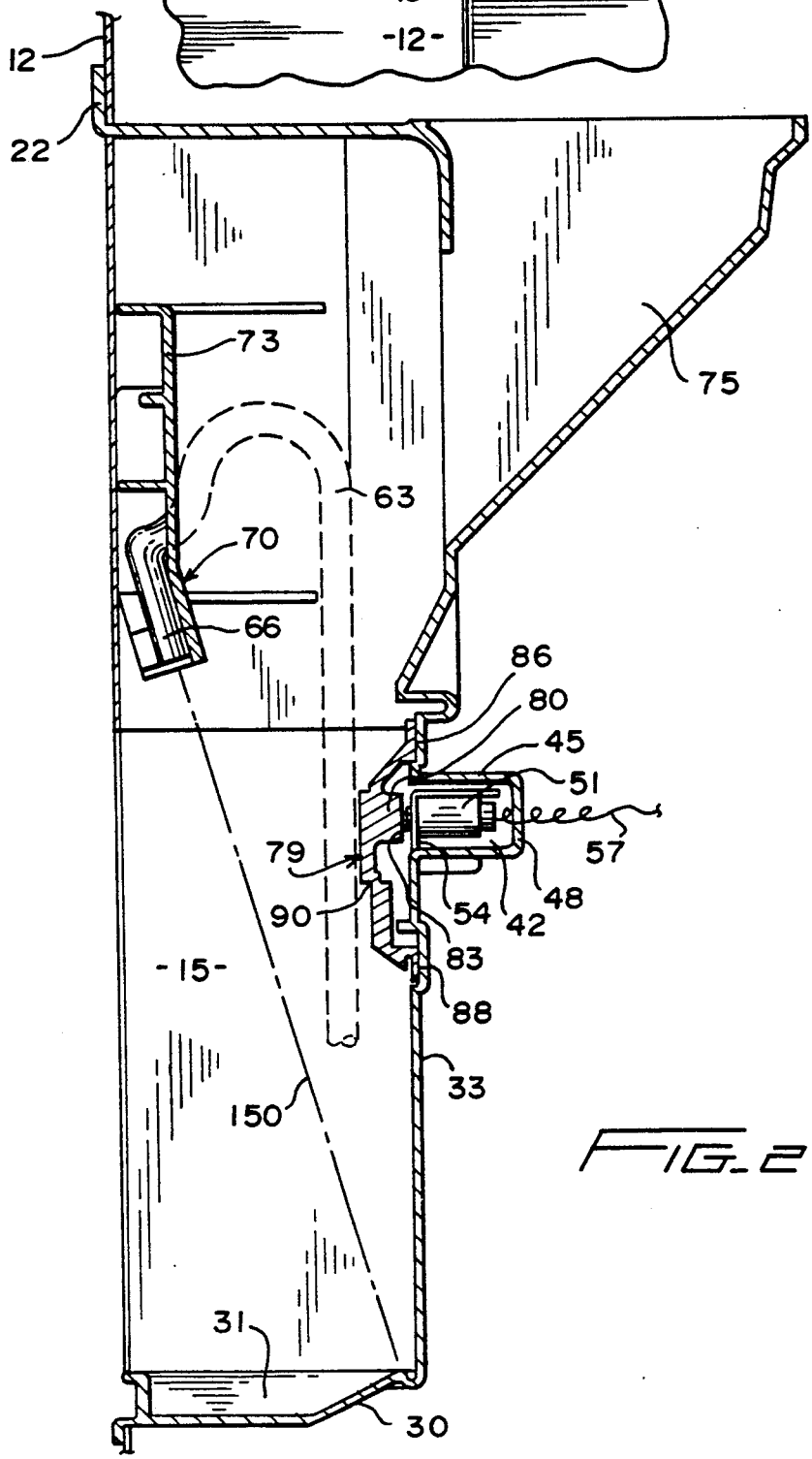
FIG. 2

LIQUID DISPENSING ASSEMBLY FOR A REFRIGERATOR

FIELD OF THE INVENTION

The present invention pertains to a liquid dispensing assembly and, more particularly, a liquid dispensing assembly for use in a refrigerator to minimize unwanted water spillage.

DISCUSSION OF THE PRIOR ART

Liquid dispensing assemblies for use in refrigerators are widely known in the art and generally include fill chambers that are recessed in a door of the refrigerator. Such liquid dispensing assemblies include liquid supply lines which either terminate in or are attached to ejector spouts. The liquid is permitted to flow through the spout in response to the actuation of a switch by a container placed in the fill chamber. It is further known in the art to dispose these spouts substantially, vertically and centrally at the top of the fill chamber and above the center of the container.

Known liquid dispensing assemblies have numerous drawbacks associated therewith. Activation switches in the prior art are intended to stop the flow of liquid through the spout upon initial removal of the container from the fill chamber. However, the liquid will actually continue to flow or drip out of the spout. As soon as the rear edge of the container is moved from below the spout, some of the liquid will continue to flow and fall into the bottom of the fill chamber. In addition, since the spout dispenses the liquid into substantially the center of the container, there is a greater tendency for splashing of the liquid to occur.

Therefore, a need exists in the art for an improved liquid dispensing assembly for a refrigerator which overcomes the problems associated with the prior art as discussed above.

SUMMARY OF THE INVENTION

It is an object of the present invention to provide a liquid dispensing assembly for use in a refrigerator which minimizes or eliminates the amount of spillage of the discharged liquid.

It is another object of the invention to provide a liquid dispensing assembly for use in a refrigerator which is simple in construction and which permits a liquid supply line to be easily and securely attached thereto.

These and other objects of the invention are realized by providing a liquid dispensing assembly including an ejector spout which is located at the top of a fill chamber, closely adjacent the inner surface of a refrigerator door, and is angled downwardly and rearwardly so as to maintain the flow above a container placed in the fill chamber for as long as possible following a filling operation and during removal of the container. In the preferred embodiment of the invention, the ejector spout is defined by a nozzle unit that is integrally formed with a support structure of the liquid dispensing assembly. The support structure is also formed so as to define a passage through which a liquid supply line can extend with the end of the supply line projecting into the nozzle unit.

These and other objects of the invention will become more readily apparent from the following detailed description of a preferred embodiment thereof when taken in conjunction with the drawings wherein like reference numerals refer to corresponding parts in the several views.

BRIEF DESCRIPTION OF THE DRAWINGS

FIG. 1 depicts a partial front view of a refrigerator incorporating a liquid dispensing assembly according to the invention.

FIG. 2 depicts a cross-sectional side view of the liquid dispensing assembly of the invention.

DETAILED DESCRIPTION OF A PREFERRED EMBODIMENT

Figure 3:
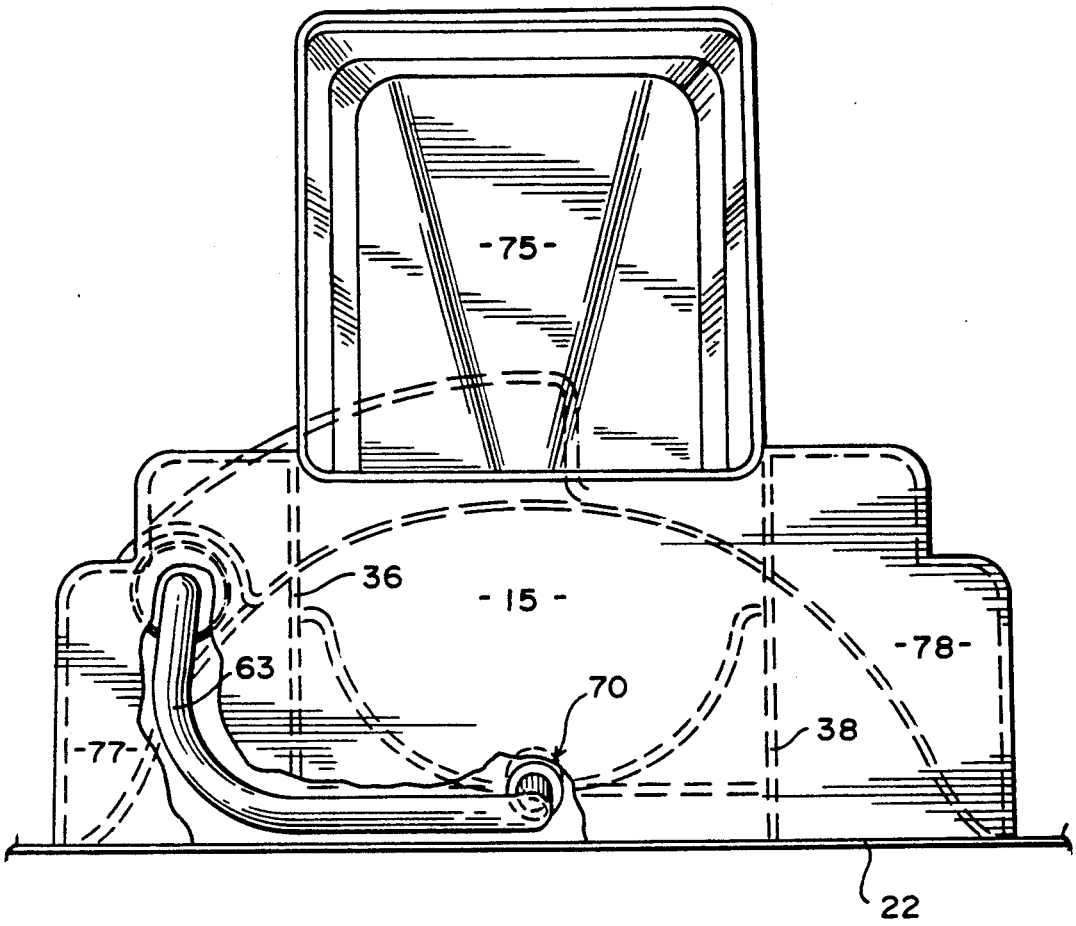
FIG. 3 is a top view of the liquid dispensing assembly shown in FIG. 2.

The dispensing assembly 5 of the invention is shown in FIG. 1 mounted in a refrigerator 8 and is adapted to dispense a liquid and/or ice, however, since the invention is only directed to the liquid dispensing system, the ice dispensing system will not be discussed herein in detail. As depicted, refrigerator 8 is a conventional side-by-side refrigerator having a refrigerator door 10 and a freezer door 12. Dispensing assembly 5 includes a fill chamber 15 which is recessed within freezer door 12. A container 18 is adapted to be placed within fill chamber 15 in order to be filled with a liquid, such as water, or ice depending upon the position of a manually adjustable selector switch 20.

Figure 4:
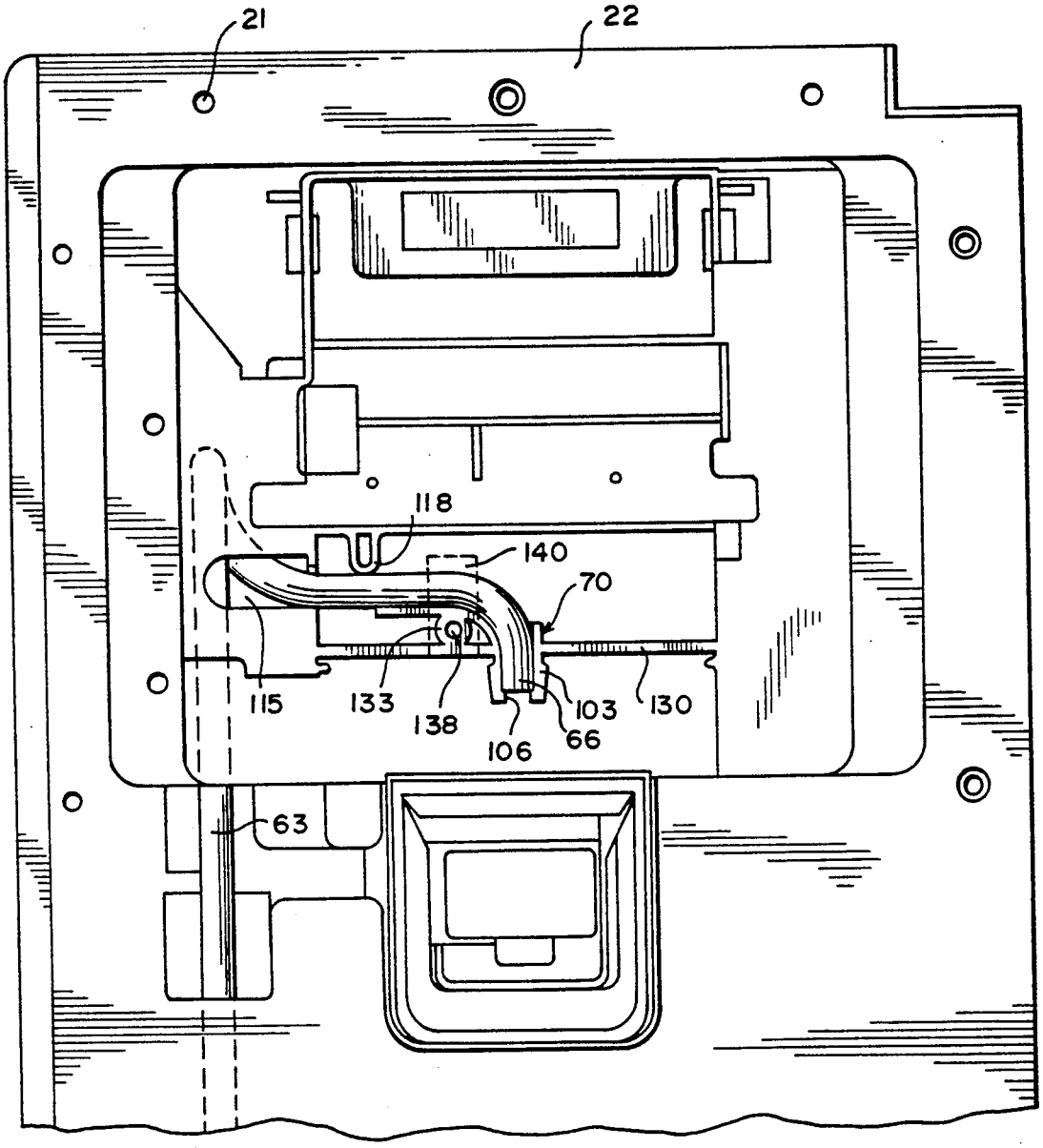
FIG. 4 shows a front view of the liquid dispensing assembly of the invention.

Reference will now be made to FIGS. 2–4 in describing the preferred embodiment of dispensing assembly 5. Dispensing assembly 5 is adapted to be secured within an opening (not shown) formed in freezer door 12 by means of screws or another known type of fastener which extend through holes 21 spaced about a peripheral flange portion 22 of dispensing assembly 5. Fill chamber 15 of dispensing assembly 5 includes a base wall 30 having a reservoir 31, a rear upstanding wall 33 and a pair of laterally spaced side walls 36 and 38. In the preferred embodiment, fill chamber 15 is integrally formed as a unit from molded plastic. Rear wall 33 is integrally formed wit a concavity 42 defined by a rearwardly extending annular wall 45 which terminates in a back wall 48.

A switch 51 is secured within concavity 42 by means of a bracket 54. Switch 51 is preferably an electric switch which receives power through a wire 57 and is used to control a solenoid valve (not shown) that is located remote from dispenser assembly 5. A fluid supply line 63, preferably formed of plastic, includes a terminal end 66 which projects within an ejector spout 70 of dispenser assembly 5 as will be discussed more fully below. Ejector spout 70 is integrally formed with a bracket 73 that is attached to or integrally formed with side walls 36 and 38. An upper portion of dispenser wall 33 also forms an ice chute 75 leading to fill chamber 15 in a manner known in the art. Dispenser assembly 5 further includes left and right side chambers 77, 78 which house electrical components and a portion of supply line 63, as well as providing additional structural support. As ice chute 75 and side chambers 77, 78 do not form part of the present invention, they will not be discussed in detail herein.

Located within fill chamber 15 is an actuation member 79. Actuation member 79 includes an engagement knob 80 which is adapted to depress a contact 83 of switch 51. Upon depression of contact 83, the above-mentioned solenoid valve permits the liquid to flow through supply line 63 and to be dispensed through ejector spout 70. More particularly, actuation member 79 is attached to rear wall 33 of fill chamber 15 at 86 and 88. Actuation member 79 is preferably made from rubber or flexible plastic and includes at least one pliable area 90 which can bend upon engagement by a container 18 in order to permit engagement knob 80 to activate switch 51. Pliable area 90 biases activation member 79 away from contact 83 so that with container 18 removed from fill chamber 15, activation member 79 will assume the position shown in FIG. 2. At this point it should be recognized that the above-described structure of actuation member 79 is a preferred arrangement and that other types of actuation assemblies could also be utilized.

Figure 5:
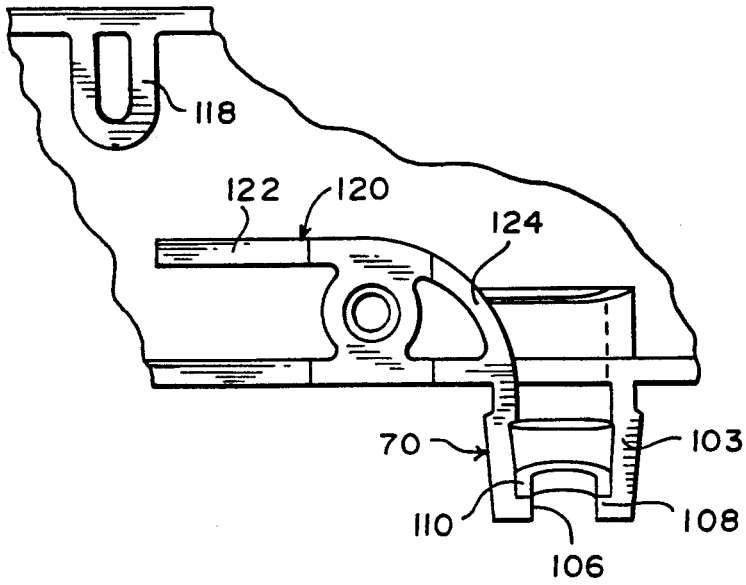
FIG. 5 is an enlarged view of a portion of the liquid dispensing assembly shown in FIG. 4.

Reference will now be made to FIGS. 4 and 5 in describing the particular construction of ejector spout 70 and the attachment of supply line 63 therein. Ejector spout 70 includes a tubular sheath 103 which terminates in a nozzle opening 106. Nozzle opening 106 is actually defined by a flange 108 that projects radially inwardly from the lower end of sheath 103. Flange 108 further defines an inner ledge 110. Fluid supply line 63 extends from a fluid supply source (not shown) through a portion of the body of refrigerator 8 and projects through a hole 115 formed in bracket 73. Bracket 73 is also integrally formed with a downwardly extending flange member 118 and a lower, contoured guide member 120. Contoured guide member 120 actually includes a first, substantially horizontal section 122 and a second, curved section 124. Curved section 124 is formed integral with a portion of sheath 103, as best shown in FIG. 5. Guide member 120 is joined with a lower transverse support member 130 of bracket 73 by an interconnecting piece 133. Interconnecting piece 133 includes a central aperture 138 for attaching a retainer plate 140 (shown in dotted lines in FIG. 4) as will be more fully discussed below.

After liquid supply tube 63 projects through hole 115 in bracket 73, supply tube 63 is fed along contoured guide member 120, below flange 118, and is inserted into sheath 103 of ejector spout 70 such that the terminal end 66 of supply tube 63 engages inner ledge 110. With this arrangement, as best shown in FIG. 4, supply tube 63 is frictionally maintained between flange 118 and contoured guide member 120 and snugly fits within sheath 103. In this manner, supply line 63 is easily connected to ejector spout 70 in a simple, yet secure way. Retainer plate 140 can be additionally secured to interconnecting piece 133 so as to extend over a portion of supply line 63 to further secure supply line 63 in place.

As shown in FIG. 2, ejector spout 70 is mounted above fill chamber 15 and projects downwardly and rearwardly such that a longitudinal axis 150 defined by the centerline of the axial discharge path of ejector spout 70 through nozzle opening 106 intersects adjacent the interconnection of base wall 30 and rear wall 33 of fill chamber 15. Due to this arrangement, when container 18 is placed in fill chamber 15 and engages actuation member 79 to control the position of switch 51, liquid will generally flow through ejector spout 70 against a rear wall of container 18. This will reduce the amount of splashing of the liquid. Furthermore, due to the angling of the axial discharge path of ejector spout 70, as container 18 is removed from fill chamber 15 and switch 51 deactivates the solenoid valve, substantially all the afterflow liquid from ejector spout 70 will be collected in container 18. This occurs since the first additional liquid out of ejector spout 70 will fall in container 18 adjacent the front of container 18. The motion of the collapsing stream of liquid will tend to follow the motion of chamber 18 as container 18 is being withdrawn from chamber 15 by the user. If ejector spout 70 were to be located farther rearward in fill chamber 15, this first additional liquid would fall somewhat rearward of the middle of container 18, as in the prior art. Therefore, as compared to the prior art, the liquid stream will remain above the container for a longer period of time thus reducing or eliminating spillage of residual liquid after dispensing is completed.

In practice, it has been found that refrigerators provided with water tanks formed from winding polyethylene tubing or the like about a core member evince low afterflow following deactivation of the solenoid flow control valve while refrigerators provided with blow molded tanks have significant afterflow. The amount of afterflow can also depend on the diameter of the fluid supply line as well as the distance between the flow control valve and the dispenser nozzle. In any event, the present invention has been found to substantially minimize, if not eliminate spillage of the afterflow. Instead, the afterflow is directed into the container due to the manner in which the ejector spout of the present invention is arranged. It has also been found advantageous to mount actuation member 79 at an upper position along rear wall 33 to assure proper positioning of container 18 within fill chamber 15.

Although described with respect to a preferred embodiment, it should be understood that various changes and/or modifications can be made to the invention without departing from the spirit thereof. In general, the invention is only intended to be limited by the scope of the following claims.

We claim:

1. A liquid dispensing assembly for use on a refrigerator including a door comprising:

a fill chamber including a base well, a rear upstanding wall and opposed side walls, said fill chamber being recessed within and accessible through the door;

a liquid supply line;

means for controlling the flow of liquid in said supply line in response to the insertion of a container into the fill chamber;

an ejection spout defined at a terminal end of a liquid supply line, said ejection spout being located above said fill chamber and defining an axial liquid discharge path angled downwardly and rearwardly, whereby upon activation of said flow controlling means, liquid flowing through said supply line will be dispensed into the container through said spout and when said flow controlling means is deactivated upon removal of the container from the fill chamber, any remaining liquid flowing through said spout will fall into the container prior to its complete removal from the fill chamber; and means for retaining said supply line in a predetermined position so as to maintain said axial liquid discharge path in a desired orientation, said retaining means including a contoured guide member along which said liquid supply line extends and a flange member, said liquid supply line being maintained between said contoured guide member and said flange member.

2. A liquid dispensing assembly for use on a refrigerator door comprising:

a fill chamber defined within an accessible opening formed in the door and including front and rear portions;

a liquid supply line having a terminal end portion located above said fill chamber, adjacent the accessible opening formed in the door, that opens into the front portion of said fill chamber;

means for controlling the flow of liquid through said supply line in response to the insertion of a container into the rear portion of said fill chamber; and means for retaining said liquid supply line in a predetermined orientation wherein said terminal end portion thereof defines an axial liquid discharge path angled downwardly and rearwardly, whereby upon actuation of said flow controlling means, liquid is dispensed into the container through said supply line and when said flow controlling means is deactivated upon withdrawal of the container from the rear portion of said fill chamber, remaining liquid flowing through said supply line will fall into the container as the container is being completely removed from the fill chamber.

3. The liquid dispensing assembly of claim 2, wherein said retaining means comprises a contoured guide member along which said liquid supply line extends and a flange member, said liquid supply line being maintained between said contoured guide member and said flange member.

4. The liquid dispensing assembly of claim 2, wherein said controlling means comprises an actuation member engageable by the container and a valve controlling switch engageable by said actuating member.

5. The liquid dispensing arrangement of claim 1, wherein said ejection spout defines a tube in which the terminal end of said supply line is position, said contoured guide member being formed integral with said ejection spout.

6. The liquid dispensing arrangement of claim 1, further including a bracket member extending between said side walls, said contoured member and said flange member being integrally formed with said bracket member.

7. The liquid dispensing arrangement of claim 6, wherein said bracket member includes a support member and an interconnecting piece, said support member being attached to said contoured guide member by said interconnecting piece.

8. The liquid dispensing arrangement of claim 7, further including a retainer plate secured to said interconnecting piece and extending over a portion of said liquid supply line.

9. The liquid dispensing arrangement of claim 1, wherein said controlling means comprises an actuation member engageable by the container and a valve controlling switch engageable by said actuation member.

10. The liquid dispensing arrangement of claim 9, wherein said actuation member is resiliently biased out of engagement with said switch.

11. The liquid dispensing arrangement of claim 10, wherein the rear upstanding wall of said fill chamber is formed with a concavity within which said switch is housed.

12. The liquid dispensing arrangement of claim 1, wherein the axial liquid discharge path of said ejection spout projects downwardly and rearwardly proximate the intersection of the base wall and the rear upstanding wall of said fill chamber.

13. A method of filling a container within a liquid dispensing assembly fill chamber extending rearwardly from an accessible opening formed in a refrigerator door comprising:

inserting a container into the fill chamber to a position spaced rearwardly from the accessible opening;

activating a liquid flow controlling unit in response to the insertion of the container;

dispensing liquid downwardly and rearwardly through a terminal end portion of a liquid supply line located above said fill chamber adjacent the accessible opening formed in the refrigerator door in response to activation of said liquid flow controlling unit;

deactivating the liquid flow controlling unit by initiating removal of the container from the fill chamber; and continuing to collect remaining liquid flowing through the liquid supply line as the container is completely removed from the fill chamber.

* * * * *